US005729122A

United States Patent [19]

Nakamura

[11] Patent Number: 5,729,122

[45] Date of Patent: Mar. 17, 1998

[54] UNIT USING IC DEVICE HAVING CONSTANT-CURRENT CIRCUITRY

[75] Inventor: Hiroyuki Nakamura, Atsugi, Japan

[73] Assignee: Canon Kabushiki Kaisha, Tokyo, Japan

[21] Appl. No.: 695,216

[22] Filed: Jul. 31, 1996

Related U.S. Application Data

[62] Division of Ser. No. 483,883, Jun. 7, 1995, Pat. No. 5,570,009, which is a continuation of Ser. No. 371,611, Jan. 12, 1995, abandoned, which is a continuation of Ser. No. 79,834, Jun. 22, 1993, abandoned, which is a continuation of Ser. No. 614,497, Nov. 16, 1990, abandoned.

[30] Foreign Application Priority Data

Nov. 22, 1989 [JP] Japan ..... 1-302223
Nov. 8, 1990 [JP] Japan ..... 2-301092

[51] Int. Cl.[6] ..... G05F 3/22; G05F 3/26

[52] U.S. Cl. ..... 323/315; 323/316; 323/267; 323/272

[58] Field of Search ..... 323/313–316, 323/297, 271, 272, 353, 354

[56] References Cited

U.S. PATENT DOCUMENTS

| | | | |
|---|---|---|---|
| 3,679,963 | 7/1972 | Free et al. | 323/315 |
| 3,743,850 | 7/1973 | Davis | 307/32 |
| 4,118,712 | 10/1978 | Kawasaki | 323/313 |
| 4,509,156 | 4/1985 | Ohara et al. | 369/54 |
| 4,716,305 | 12/1987 | Sakuragi et al. | 307/296 |
| 4,758,820 | 7/1988 | Tateno | 340/347 DA |
| 4,947,103 | 8/1990 | Abdi et al. | 323/316 |
| 5,029,295 | 7/1991 | Beunett et al. | 323/316 |
| 5,570,009 | 10/1996 | Nakamura | 323/315 |

*Primary Examiner*—Adolf Berhane

*Attorney, Agent, or Firm*—Fitzpatrick, Cella, Harper & Scinto

[57] ABSTRACT

Constant-current circuitry supplying constant current so as to drive a plurality of circuit blocks using a plurality of drive circuits. The constant-current circuitry includes not only a plurality of transistors for supplying current to the drive circuits, but also a bias circuit for supplying a predetermined voltage to the bases of the transistors. The bases of the transistors are commonly connected, and the emitters of the transistors are connected to the drive circuits. Such constant-current circuitry prevents the circuit blocks from interfering with each other.

3 Claims, 9 Drawing Sheets

UNIT USING IC DEVICE HAVING CONSTANT-CURRENT CIRCUITRY

This application is a division of application Ser. No. 08/483,883 filed Jun. 7, 1995, now U.S. Pat. No. 5,570,009 which is a continuation of application Ser. No. 08/371,611 filed Jan. 12, 1995, now abandoned, which is a continuation of application Ser. No. 08/079,834 filed Jun. 22, 1993, now abandoned, which is a continuation of application Ser. No. 07/614,497 filed Nov. 16, 1990, which is now abandoned.

BACKGROUND OF THE INVENTION

1. Field of the Invention

The present invention relates to constant-current circuitry suitable for use in regeneration units, such as magnetic disks, optical disks, or magneto-optic disks. More particularly, it relates to constant-current circuitry suitable for use as a semiconductor IC.

2. Related Background Art

Constant-current circuitry used in a semiconductor IC, for example, that shown in FIG. 1A, has hitherto been known.

In FIG. 1A, reference characters $T_1$ through $T_n$ denote NPN transistors; reference characters $T_a$ and $T_b$ denote NPN transistors for supplying the NPN transistors $T_1$ through $T_n$ with a constant current; and reference characters $R_0$ through $R_n$ denote resistors. Numeral 1 denotes a power supply line connected to a power supply; 2 a GND line retained by a ground potential; 3 a constant-current source; and 6 a base line for feeding the constant current to the NPN transistors $T_1$ through $T_n$.

The feature of the constant-current circuitry shown in FIG. 1A is that the base line 6 of the NPN transistors $T_1$ through $T_n$ is commonly utilized and is equally biased in order to feed the constant current to all the NPN transistors $T_1$ through $T_n$ connected to circuits 1, 2.

The constant-current circuitry shown in FIG. 1A, however, has a technical problem to be eliminated, that is, the circuit block 1 and the circuit block 2 interfere with each other. This is because the base line 6 of the NPN transistors $T_1$ through $T_n$ is commonly utilized.

To solve such a problem, constant-current circuitry has been known in which the constant-current source of a PNP transistor separates circuits from each other which are not intended to be interfered with. An example of such constant-current circuitry is shown in FIG. 1B, in which reference characters 7 and 7' indicate PNP transistors.

According to the knowledge of the inventor of the present invention, with the constant-current circuitry illustrated in FIG. 1B, no problems occur when a frequency of several tens to several hundreds KHz is used. When a frequency of more than several MHz is used, however, even with the above constant-current circuitry, the circuit block 1 and the circuit block 2 will interfere with each other. As a result of such interference, it is impossible to guarantee the accurate operations of the circuitry. Based on the result of numerous experiments and investigations performed by the inventor, it seems that the interference is ascribable to the parasitic capacity $C_{BC}$ between the PNP transistors 7, 7' and the collector/base. For a high frequency region of more than several MHz which is greatly susceptible to interference, it has therefore been proved that a technical means is required to solve such a problem.

SUMMARY OF THE INVENTION

The present invention has been accomplished in view of the above technical problem. An object of the invention is therefore to provide constant-current circuitry with no interference between circuits which thus guarantees accurate operations, and also to provide a semiconductor IC device including this circuitry.

Another object of the present invention is to provide a unit which guarantees accurate operations and which is capable of recording and/or reproducing information.

A further object of the invention is to provide constant-current circuitry supplying constant current so as to drive a plurality of circuit blocks by a plurality of drive circuits, and to provide a semiconductor IC device including the constant-current circuitry. The constant-current circuitry comprises a plurality of transistors for supplying current to the plurality of drive circuits, bases of the transistors being commonly connected, emitters of the transistors being connected to the drive circuits and a bias circuit for supplying a predetermined voltage to the bases of the transistors.

According to the present invention, the interference between circuits can be reduced. This is because constant voltage circuitry on the basis of a GND is provided, and because a constant voltage bias line is constructed by including an emitter/base junction whose parasitic capacity is smaller than that of a collector/base junction.

DETAILED DESCRIPTION OF THE PREFERRED EMBODIMENTS

The embodiments of the present invention will now be described with reference to the drawings.

(First Embodiment)

A first embodiment of the invention will be explained hereinafter with reference to FIGS. 2A and 2B.

Figure 1A:
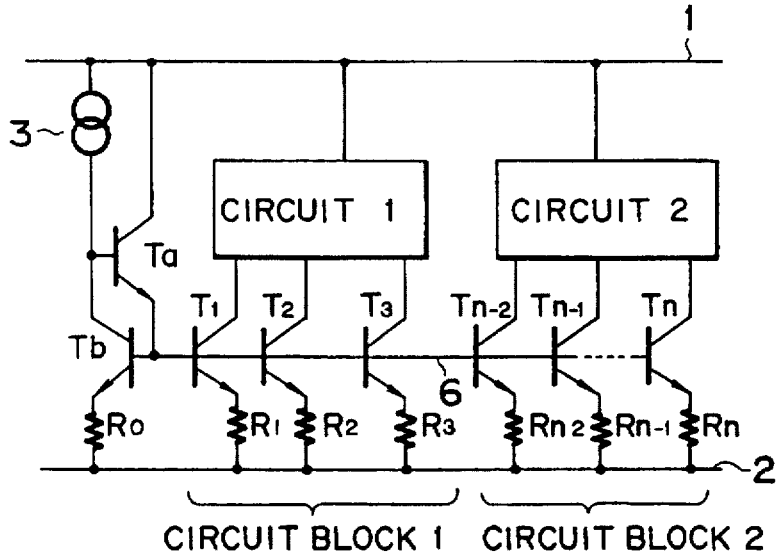
FIG. 1A PRIOR ART
FIGS. 1A and 1B are circuit diagrams showing the structure of the conventional constant-current circuitry.
Figure 1B:
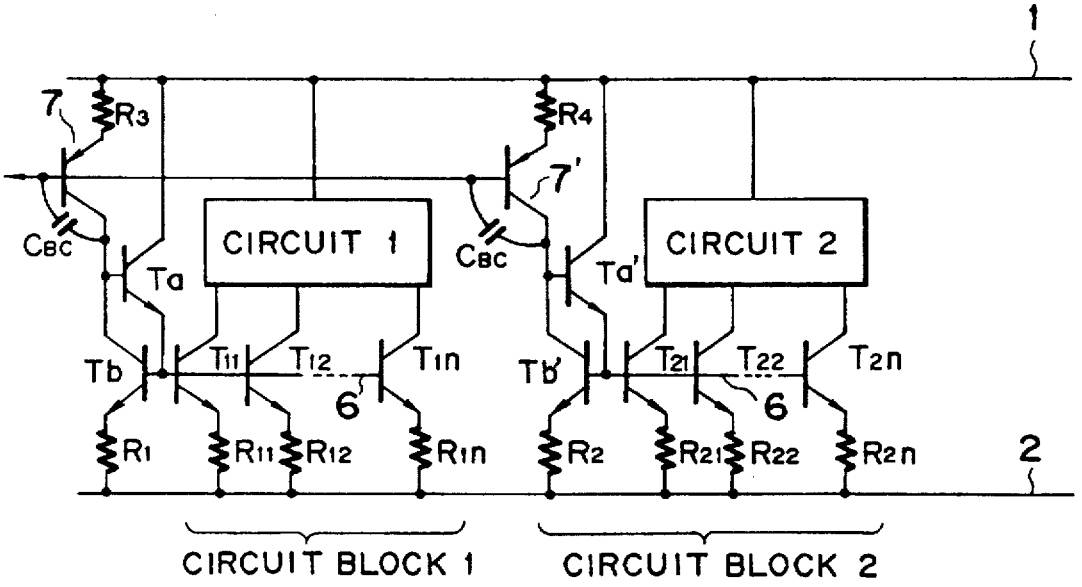
FIG. 1B PRIOR ART
Figure 2A:
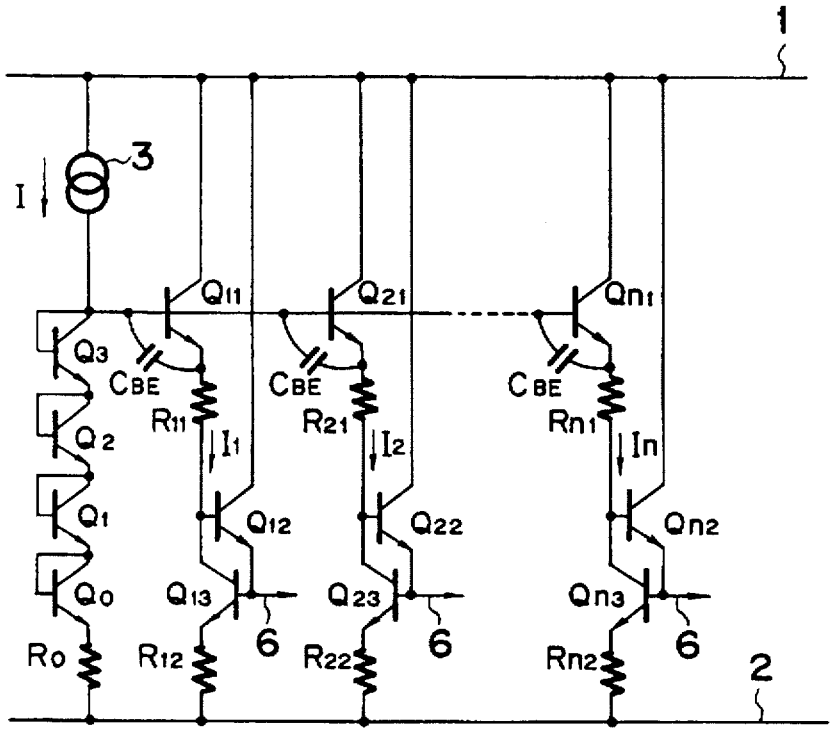
FIGS. 2A and 2B are circuit diagrams showing the structure of constant-current circuitry according to a first embodiment of the present invention.
Figure 2B:
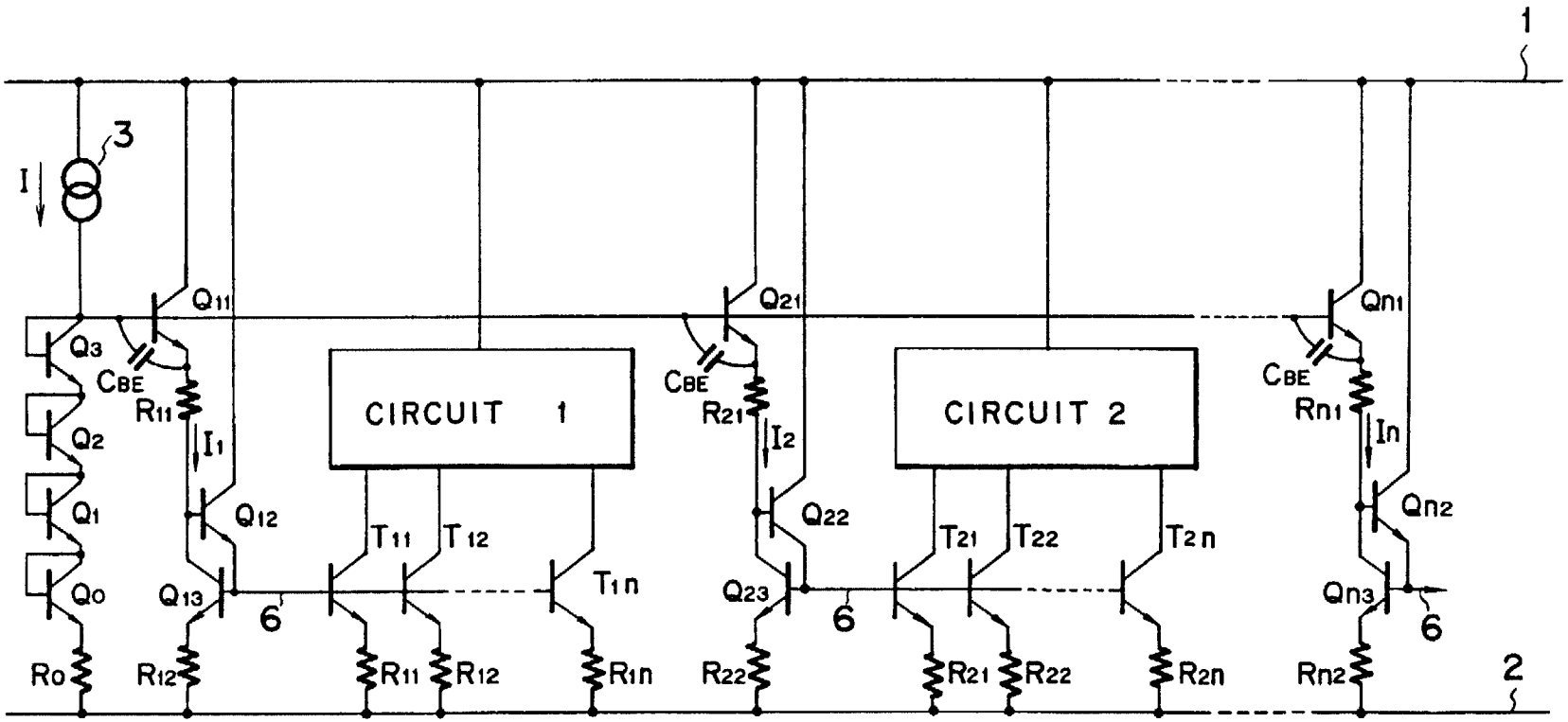

FIG. 2A shows a basic circuitry structure. FIG. 2B is a circuit diagram in which circuits 1 and 2 to be driven are included for easy understanding of the features of the present invention, and corresponds to FIG. 1B mentioned above.

In FIG. 2, numeral 1 denotes a power supply line; numeral 2 a GND line; and numeral 3 a constant-current source. Reference character $C_{BE}$ denotes a parasitic capacity within a base emitter.

Reference characters $Q_{11}$ through $Q_{n1}$ designate NPN transistors for separating circuits from each other which are not intended to be interfered with, such as the driving circuits of an optical head or a magnetic head. The bases of the NPN transistors $Q_{11}$ through $Q_{n1}$ are respectively connected to the collector and the base of an NPN transistor $Q_3$, which provides a bias voltage, and the constant-current source 3. The collectors of the NPN transistors $Q_{11}$ through $Q_{n1}$ are each connected to the power supply line 1.

Reference characters $R_{11}$ through $R_{n1}$ indicate resistors. Ends of the resistors $R_{11}$ through $R_{n1}$ are each connected to the emitters of the NPN transistors $Q_{11}$ through $Q_{n1}$. The other ends of the resistors $R_{11}$ through $R_{n1}$ are each connected to the bases of NPN transistors $Q_{12}$ through $Q_{n2}$ and the collectors of NPN transistors $Q_{13}$ through $Q_{n3}$.

The emitters of the NPN transistors $Q_{13}$ through $Q_{n3}$ are each connected to ends of resistors $R_{12}$ through $R_{n2}$. The other ends of the resistors $R_{12}$ through $R_{n2}$ are each connected to the GND line 2.

The constant-current source 3, transistors $Q_0$ through $Q_3$, and a resistor $R_0$ form constant-current circuitry, and is used for keeping the potential difference between the bases of the transistors $Q_{11}$ through $Q_{n1}$ and the GND line 2 constant. The emitter of the transistor $Q_3$ is connected to the collector as well as the base of the transistor $Q_2$; the emitter of the transistor $Q_2$ is connected to the collector as well as the base of the transistor $Q_1$; and the emitter of the transistor $Q_1$ is connected to the collector as well as the base of the transistor $Q_0$. Furthermore, the emitter of the transistor $Q_0$ is connected to one end of the resistor $R_0$, whereas the other end of the resistor $R_0$ is grounded.

Numeral 6 denotes a bias line for providing a constant current so as to drive circuit blocks 1, 2 and so on. Driving circuits, corresponding to $T_1$ through $T_n$ in FIG. 1A, $T_{11}$ through $T_{1n}$ and $T_{21}$ through $T_{2n}$ in FIG. 1B, are connected to the bases of a plurality of NPN transistors ($T_{11}$ through $T_{1n}$ and $T_{21}$ through $T_{2n}$ in FIG. 2B) which constitute $Q_{13}$, $Q_{23}$, and a current mirror.

In the constant-current circuitry shown in FIG. 2, on the assumption that the electric current of the constant-current source 3 is represented by I [mA], and the emitter electric currents of the NPN transistors $Q_{11}$ through $Q_{n1}$ are represented by $I_1$ through $I_n$ [mA], then, since the forward voltages of the diode-connected NPN transistors $Q_1$, $Q_2$, $Q_3$ offset the forward voltages of the NPN transistors $Q_{11}$, $Q_{12}$, $Q_{13}$ through $Q_{n1}$, $Q_{n2}$, and $Q_{n3}$, the following equation is obtained.

$$R_0 \cdot I_0 + V_{BE(Q0)} = (R_{11}+R_{12})I_1 = (R_{21}+R_{22})I_2 = \ldots (R_{n1}+R_{n2})I_n$$

An appropriate selection for the values $R_0$ and $I_0$ permits the value on the left side of the above equation to be a bandgap voltage value. In other words, assuming that the bandgap voltage value is $V_{BG}$, $$(R_{n1}+R_{n2})I_n = V_{BG}$$

$$[V_{BG} = 1.2 \sim 1.3V \text{ (bandgap voltage of a single crystal Si)}],$$

therefore, $$I_n = V_{BG}/R_{n1}+R_{n2}$$

$$(\text{wherein } R_0 = R_{12} = R_{22} = \ldots R_{n2}),$$

a constant-current value can thus be determined.

In this embodiment, the constant-current source 3, the transistors $Q_0$ through $Q_3$, and the resistor $R_0$ form constant-current circuitry on the basis of the GND line 2. The capacity between the emitters and the bases of a plurality of NPN transistors, which constitute a current mirror, is included in the bias line. Since the capacity between the emitter and the base is normally smaller by one digit or more than the capacity between the collector and the base, the effect of noise is remarkably reduced, as compared with the conventional constant-current circuitry.

For example, even when the circuit blocks 1, 2 are utilized for dealing with a driving signal whose peak-to-peak values are 4V and 10 MHz, the driving signal is not interfered with.

In this embodiment, although an example has been given in which NPN transistors are used to form constant-current circuitry, it is obvious that the same effect as described above can be attained when NPN transistors are used to form a symmetrical circuit.

(Second Embodiment)

Figure 3A:
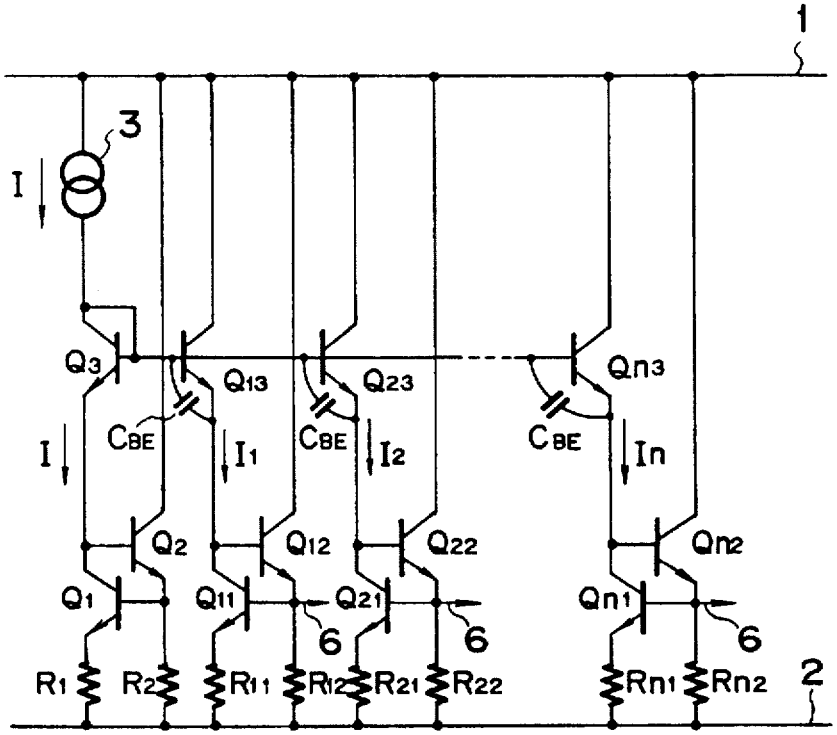
FIGS. 3A and 3B are circuit diagrams showing the structure of constant-current circuitry according to a second embodiment of the invention.
Figure 3B:
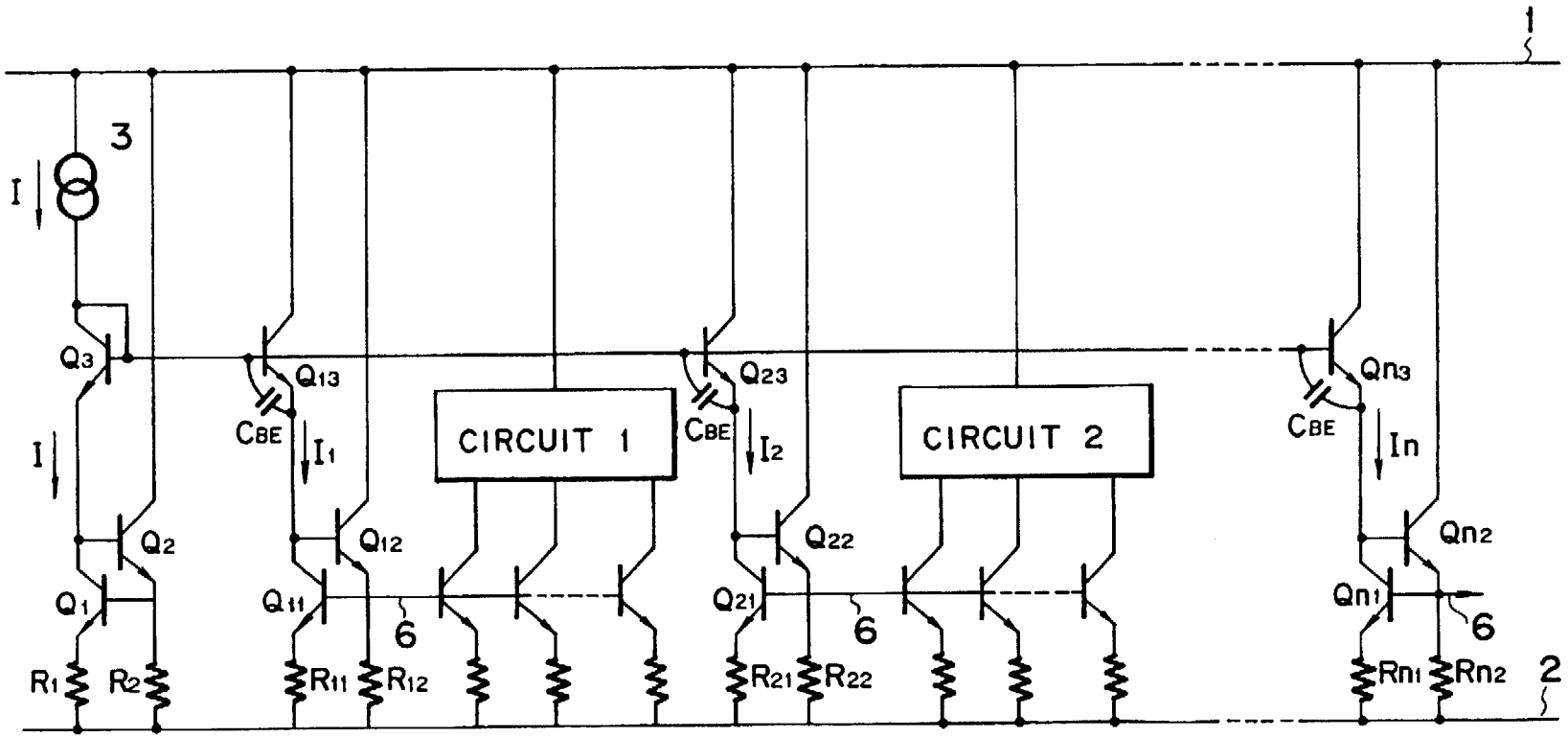

A second embodiment of the present invention will now be described with reference to FIGS. 3A and 3B. Components designated by like reference characters in FIG. 3A indicate the same components as those in FIG. 2. FIG. 3B is a circuit diagram in which the circuits 1 and 2 to be driven, are added to the circuitry shown in FIG. 3A. FIG. 3B corresponds to FIG. 1B so as to easily understand the features of this embodiment. In the constant-current circuitry shown in FIG. 3, a constant current I is converted into a constant voltage by the NPN transistors $Q_1$, $Q_2$, and $Q_3$, and resistors $R_1$ and $R_2$. That is, the electric potential $V_B$ of the short-circuited base/collector of the NPN transistor $Q_3$ is given by $$V_B = R_1 I + V_{BE(Q1)} + V_{BE(Q2)} + V_{BE(Q3)}.$$

The resistor $R_2$ is used to secure the operation of the NPN transistor $Q_2$.

With the above structure of the circuitry, the base electric potentials of $Q_{13}$, $Q_{23}$ . . . $Q_{n3}$ are rendered constant electric potentials. The following equation is obtained.

$$\begin{aligned} V_B &= R_1 I_1 + V_{BE(Q1)} + V_{BE(Q2)} + V_{BE(Q3)} \\ &= R_{n1} I_n + V_{BE(Qn1)} + V_{BE(n2)} + V_{BE(n3)} \end{aligned}$$

On the assumption that the amplification factor of the electric current of the NPN transistors is sufficiently high, thus $V_{BE}$ of $Q_2$, $Q_{12}$, $Q_{n2}$, which provide bias electric current, being the same, and that the collector electric currents of $Q_1$, $Q_3$ are the same as those of . . . $Q_{n1}$, $Q_{n3}$, then the above equation becomes $$R_1 I_1 + 2V_{BE(Q1)} = R_{n1} I_n + 2V_{BE(Qn1)}.$$

A constant-current value $I_n$ is obtained by the following equation.

$$R_n I_n + kT/q \cdot 1n \cdot I_n / I_1 = R_1 I_1.$$

When constant-current circuitry is constructed as above, like the conventional constant-current circuitry, the capacity between the collectors and the bases of a plurality of NPN transistors, which constitute a current mirror, is not included. The capacity $C_{BE}$ between the emitter and the base is included, so that the same effect as that of the first embodiment can be attained.

In this embodiment, though an example has been given in which NPN transistors are used to form constant-current circuitry, it is obvious that the same effect as described above can be attained when NPN transistors are used to form a symmetrical circuit.

Figure 4:
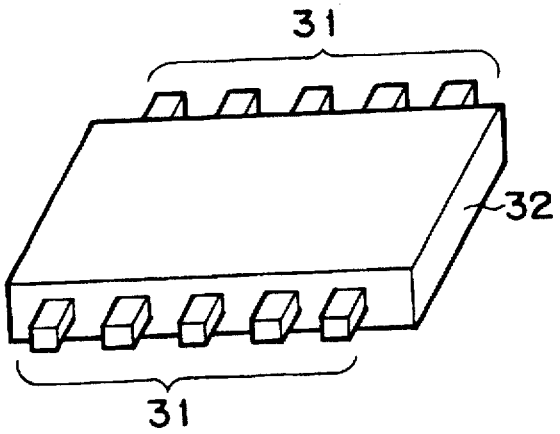
FIG. 4 is a schematic representation showing a semiconductor IC device in accordance with the invention.

FIG. 4 shows a semiconductor IC device in which the above constant-current circuitry is included. In this device, the circuitry is formed by a semiconductor process technique on a single crystal substrate. The circuitry and lead terminals 31, for connecting the circuitry to an external circuit, are bonded by wire bonding using a fine metal wire, and are contained in a ceramic package 32.

Figure 5:
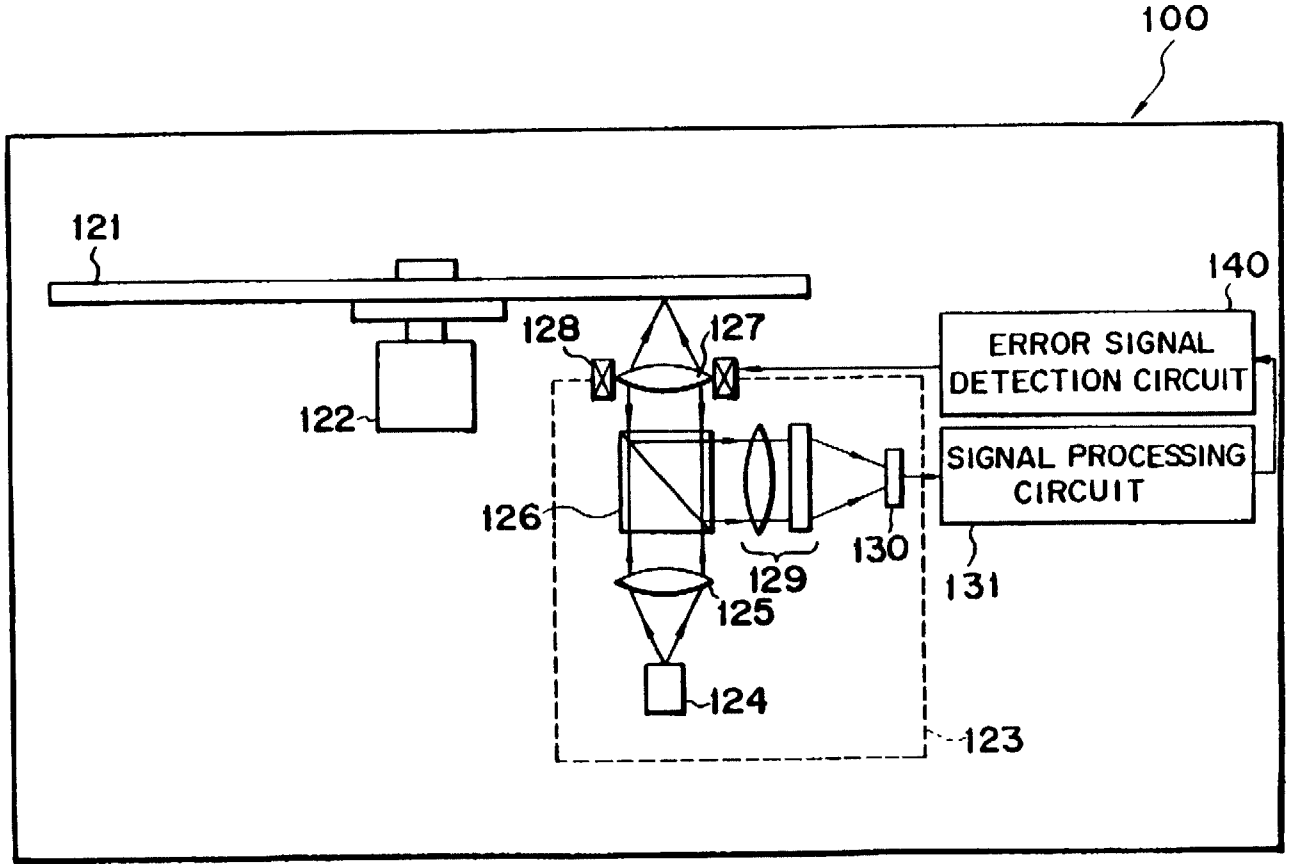
FIG. 5 is a schematic illustration showing a regeneration unit used as an example of a unit according to the invention.

FIG. 5 is a schematic illustration showing a unit on which the semiconductor IC device, including the above constant-current circuitry, is installed. In this invention, a regeneration unit utilizing an optical disk will be described as an example.

In FIG. 5, numeral 121 denotes an optical disk used as a recording medium. The optical disk 121 is held on a turn table, which is a retention means for retaining the recording medium, and is rotated by a spindle motor 122. An optical head 123 is arranged which is capable of moving in the radial direction of the rotating optical disk 121. A semiconductor laser 124 incorporated in the optical head 123 emits a light beam toward the optical disk 121. The emitting light beam is turned into parallel light by a collimator lens 125, passing through a beam splitter 126. It is then formed by an objective 127 into an image on the optical disk 121 as a fine spot. This light beam is used to record and/or regenerate information on the optical disk 121.

On the other hand, light reflected from the optical disk 121 passes again through the objective 127, and is split into impinging beams by the beam splitter 126. The reflected light, which has been separated, passes through an anamorphic optical system 129 in which the image-formation positions are different in two directions perpendicular to each other, and reaches a photoelectric conversion element 130. The photoelectric conversion element 130 is composed of a plurality of optical sensors. The output electric current from the optical sensors is converted into voltage by a signal processing circuit 131. An error signal detection circuit 140 generates, based on the converted voltage, focusing error signals as well as tracking error signals.

In this embodiment, the focusing error signal is used for causing the light beam irradiated onto the optical disk 121 to be accurately focused on the optical disk 121. In accordance with the focusing error signal, an actuator 128, arranged inside the optical head 123, drives the objective 127 in its optical axis direction, thereby controlling the focus. The tracking error signal controls information tracks formed in a concentric manner or in a spiral manner on the optical disk 121 so that the light beam may accurately trace the information tracks. This tracking error signal also returns to the actuator 128 in the form of feedback, and is used to drive the objective 127 across the information tracks. A method of detecting such error signals will be explained hereinafter.

Figure 6A:
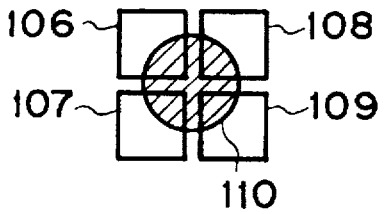
FIGS. 6A through 6C are front views schematically showing a photoelectric conversion element in FIG. 5.
Figure 6B:
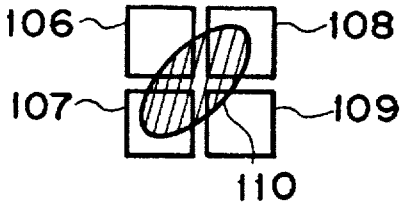
Figure 6C:
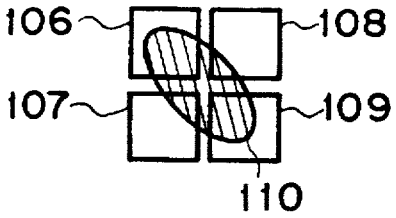

FIGS. 6A through 6C are front views showing the photoelectric conversion element 130 in FIG. 5. The photoelectric conversion element 130 is made up of four optical sensors 106, 107, 108, 109. Light reflected from the optical disk 121 impinges upon a light receiving region in the form of a spot 110, as indicated by the shaded portions. The shape of the spot 110 changes in accordance with how the light beam irradiated onto the optical disk 121 is focused. When the light beam is accurately formed into an image on the disk 121, the circular spot 110, as in FIG. 6A, is formed, whereby the optical sensors 106 through 109 each output equal electric current. On the other hand, when the light beam is formed into an image before and after the optical disk 121, the spot 110 becomes elliptical, as shown in FIGS. 6B and 6C, respectively. A focusing error signal is therefore obtained from a difference signal in which the sum of the outputs from the optical sensors 106 and 109 is subtracted from the sum of the outputs from the optical sensors 107 and 108.

On the other hand, a bright and dark pattern is formed on the spot 110 according to the positional relationship between the light beam irradiated onto the disk 121 and the information tracks. Furthermore, a dividing line between the optical sensors 106, 107 and the optical sensors 108, 109 is drawn parallel to the longitudinal direction of an image formed by the reflected light on the information tracks. A tracking error signal is therefore obtained by subtracting the output sum of the optical sensors 108, 109 from the output sum of the optical sensors 106, 107.

Figure 7:
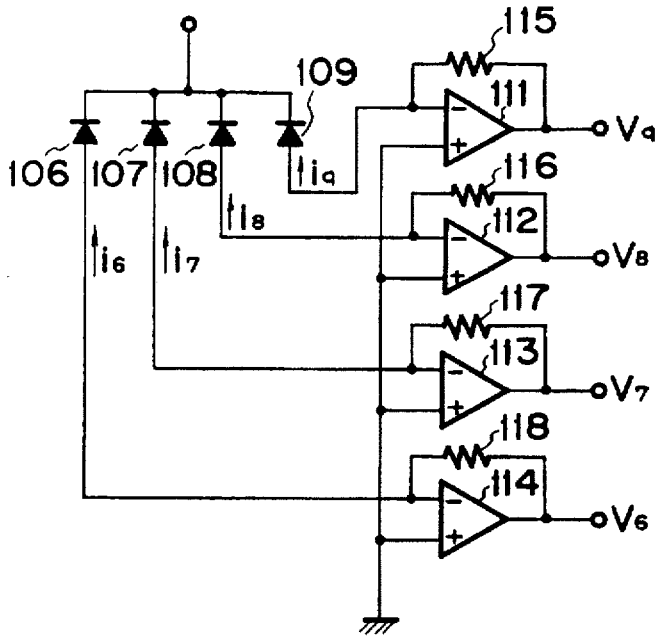
FIG. 7 is a schematic illustration showing a part of the signal processing circuit in FIG. 5.

FIG. 7 is a view showing the structure of one circuit in the conventional signal processing circuit in which the output electric current of the photoelectric conversion element mentioned above is converted into voltage. In FIG. 7, numerals 111, 112, 113, and 114 all designate difference amplifiers. Numerals 115, 116, 117, and 118 all designate resistors, each having the same resistance value R. The above circuit converts electric currents $i_6$, $i_7$, $i_8$, $i_9$, flowing through the optical sensors 106, 107, 108, 109, into voltages corresponding to the amount of each of the above electric currents, these optical sensors 106, 107, 108, 109 being made up of photo diodes or the like. Assuming that the output voltages of operational amplifiers 111, 112, 113, 114 are represented by $V_9$, $V_8$, $V_7$, $V_6$, respectively, then the relationship $V_6=R\cdot i_6$, $V_7=R\cdot i_7$, $V_8=R\cdot i_8$, $V_9=R\cdot i_9$ is satisfied.

Figure 8:
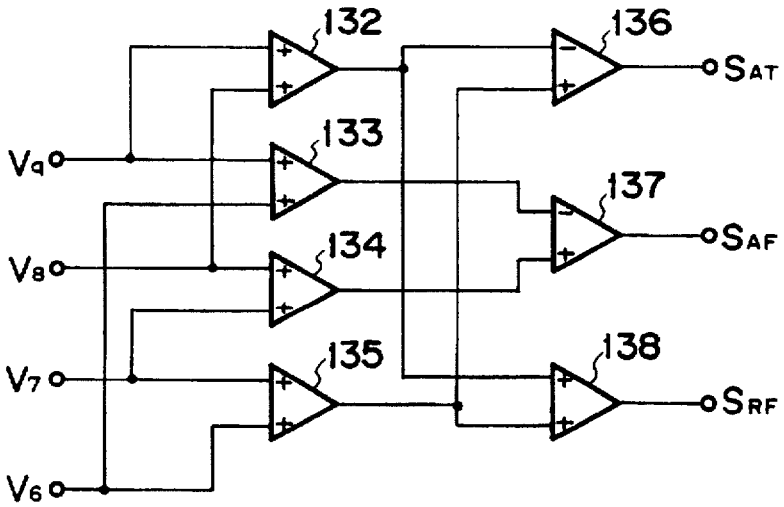
FIG. 8 is a schematic representation illustrating the error signal detection circuit in FIG. 5.

FIG. 8 illustrates the error signal detection circuit for detecting the above focusing error signal as well as the tracking error signal, this detection being performed based on the output voltage of the signal processing circuit shown in FIG. 7. This error signal detection circuit is composed of adding amplifiers 132, 133, 134, 135, 138 and difference amplifiers 136, 137. A focusing error signal $S_{AF}$ is attained by the difference amplifier 137 as the output $(V_7+V_8)-(V_6+V_9)$. A tracking error signal $S_{AT}$, on the other hand, is output by the difference amplifier 136 as $(V_6+V_7)-(V_8+V_9)$. The adding amplifier 138 outputs a sum signal $S_{RF}$ for $V_6+V_7+V_8+V_9$. The sum signal $S_{RF}$ is a signal proportional to the total quantity of light that the four optical sensors receive. When, for example, a focusing control is being withdrawn, the sum signal $S_{RF}$ is used to detect that the disk surface approaches the vicinity of the focus meeting position. The sum signal $S_{RF}$ is also used to determine that the light beam irradiated onto the optical disk 121 is positioned either on the information tracks or on the region between the information tracks (to determine whether the light beam is so-called on-land or on-group). In addition, in a reproduction mode, i.e., when information already recorded on the optical disk 121 is reproduced, the information signal can be reproduced based on the sum signal $S_{RF}$.

The semiconductor IC device, including the constant-current circuitry disclosed in the first and second embodiments, constitutes a part of the above-mentioned signal processing circuit 131, which is used as a signal peak detector.

As has been described in detail, according to the present invention, the interference between the circuit blocks can be reduced. This is because the forward voltage of the base/emitter of a transistor is used to separate the constant-current source of the circuit blocks which are intended to be independent of the others.

The present invention thus provides constant-current circuitry which guarantees accurate operations and which may be installed on a regeneration unit so as to process signals reliably.

I claim:

1. A recording and reproducing apparatus comprising:

a head for recording information on and reproducing the information from a recording medium;

retention means for retaining the recording medium; and a signal processing circuit, wherein said head has plural photosensor sections receiving light from the recording medium, and wherein said signal processing circuit processes an output signal from said plural photosensor sections, and comprises a semiconductor integrated circuit which has a constant voltage circuit comprising:

plural driving sections having transistors for driving respectively plural loads;

plural transistors for supplying a constant current to said plural driving sections respectively, wherein each of said transistors has a base and said bases of said plural transistors are commonly connected;

a constant current source provided between said bases of said plurality transistors and a first reference voltage source; and a transistor having a base connected to said bases of said plural transistors and which constitutes, in combination with said plural transistors, a current mirror circuit, wherein said plural driving circuits of said semiconductor integrated circuit are connected to the plural loads respectively, not through said plural transistors therebetween, and wherein said plural transistors supply the constant current from emitters thereof to said driving units.

2. An apparatus according to claim 1, wherein the recording medium is an optical disk.

3. An apparatus according to claim 1, wherein said semiconductor integrated circuit is a peak detector.

* * * * *

UNITED STATES PATENT AND TRADEMARK OFFICE

CERTIFICATE OF CORRECTION

PATENT NO. : 5,729,122

DATED : March 17, 1998

INVENTOR(S) : HIROYUKI NAKAMURA

It is certified that error appears in the above-identified patent and that said Letters Patent is hereby corrected as shown below:

COLUMN 7

Line 16, "plurality" should read --plural--.

Signed and Sealed this

Tenth Day of November 1998

Bruce Lehman

*Attest:*

BRUCE LEHMAN

*Attesting Officer*

*Commissioner of Patents and Trademarks*